US010815019B2

(12) United States Patent
Schernecker

(10) Patent No.: US 10,815,019 B2
(45) Date of Patent: Oct. 27, 2020

(54) AUTOMATIC BAGGING MACHINE HAVING ROLLSTOCK SUPPORT SPOOL

(71) Applicant: Volm Companies, Inc., Antigo, WI (US)

(72) Inventor: John Schernecker, Rigby, ID (US)

(73) Assignee: Volm Companies, Inc., Antigo, WI (US)

( * ) Notice: Subject to any disclaimer, the term of this patent is extended or adjusted under 35 U.S.C. 154(b) by 328 days.

(21) Appl. No.: 15/784,681

(22) Filed: Oct. 16, 2017

(65) Prior Publication Data

US 2019/0112088 A1 Apr. 18, 2019

(51) Int. Cl.
*B65B 41/16* (2006.01)
*B65B 9/08* (2012.01)
*B65B 43/12* (2006.01)

(52) U.S. Cl.
CPC ..... *B65B 41/16* (2013.01); *B65B 9/08* (2013.01); *B65B 43/123* (2013.01)

(58) Field of Classification Search
CPC ..... B65B 41/16; B65B 43/123; B65B 9/08
USPC ..... 53/562, 570, 284.7, 389.2; 242/534, 242/534.1, 534.2, 590, 591, 592
See application file for complete search history.

(56) References Cited

U.S. PATENT DOCUMENTS 2,671,587 A * 3/1954 Vogt ..... B65B 43/123 53/136.5
3,112,588 A 12/1963 Barraclough
3,359,703 A * 12/1967 Quaadgras ..... B65B 43/36 53/493
3,597,895 A * 8/1971 Jensen ..... B65B 9/093 53/455
3,618,286 A * 11/1971 Membrino ..... B65B 43/267 53/459
3,751,875 A * 8/1973 Membrino ..... B65B 9/093 53/568

(Continued)

FOREIGN PATENT DOCUMENTS

EP 0 885 806 A1 12/1998
FR 2 746 369 A1 9/1997

OTHER PUBLICATIONS

Manter International B.V., RSB-P Brochure, Weighing and Packaging Equipment, Oct. 16, 2017, pp. 1-3.

(Continued)

*Primary Examiner* — Hemant Desai
*Assistant Examiner* — Christopher Robin Kim
(74) *Attorney, Agent, or Firm* — Boyle Fredrickson S.C.

(57) ABSTRACT

A rollstock support spool supports rollstock formed from a continuous web of bags of non-uniform thickness along their length. The spool has a hollow core and first and second opposed rims. The hollow core has opposed axial ends, an inner peripheral surface defining a tubular opening configured for mounting over a spindle, and an outer peripheral surface configured to support the rollstock. The rims are located at or near the first and second ends of the core, respectively. A radial spacing between the outer peripheral surface of the core and the outer peripheral surface of each of the rims is greater than a maximum thickness of the rollstock. Also provided are an unwinder assembly incorporating such a rollstock support spool and an automatic bagger incorporating such an unwinder assembly.

17 Claims, 10 Drawing Sheets

(56) References Cited

U.S. PATENT DOCUMENTS 3,789,574 A * 2/1974 Weikert ..... B65B 39/14 53/506
3,923,084 A * 12/1975 Matthews ..... B65B 9/087 141/144
4,015,771 A 4/1977 Sengewald
4,074,504 A 2/1978 Greenawalt et al.
4,079,662 A 3/1978 Puccetti et al.
4,091,595 A 5/1978 Pelster et al.
4,260,116 A 4/1981 Collin
4,274,539 A 6/1981 Rabeneck et al.
4,470,153 A 9/1984 Kenan
4,519,504 A 5/1985 Nausedas
4,562,691 A 1/1986 Rapparini
4,654,878 A 3/1987 Lems
4,690,280 A 9/1987 Meyer
4,690,345 A * 9/1987 Cotey ..... B65H 75/185 206/416
4,694,959 A 9/1987 Ausnit et al.
4,738,385 A * 4/1988 Bell ..... A47K 10/40 225/106
4,759,639 A 7/1988 DeMatteis
4,779,996 A 10/1988 Sengewald
4,834,554 A 5/1989 Stetler, Jr. et al.
4,844,956 A * 7/1989 Galimberti ..... B65D 31/147 428/35.5
4,883,450 A 11/1989 Benoit
4,893,453 A * 1/1990 Weikert ..... B65B 39/00 141/280
4,904,092 A * 2/1990 Campbell ..... B65D 33/001 206/390
4,911,872 A 3/1990 Hureau et al.
4,964,261 A 10/1990 Benn
4,974,968 A 12/1990 Mandus et al.
5,167,377 A * 12/1992 Chalmers ..... A47F 13/085 119/161
5,179,816 A * 1/1993 Wojnicki ..... B65B 43/04 53/133.4
5,210,993 A 5/1993 van Boxtel
5,226,735 A 7/1993 Beliveau
5,255,497 A 10/1993 Zoromski et al.
5,395,067 A * 3/1995 Kano ..... B65H 23/0204 226/19
5,410,857 A 5/1995 Utley
5,465,842 A 11/1995 Utley
5,657,943 A 8/1997 Nugent
5,715,656 A 2/1998 Pearce
D394,604 S 5/1998 Cammack
5,912,197 A 6/1999 Madderom
5,975,394 A * 11/1999 Shuval ..... B65D 33/002 225/106
5,996,319 A * 12/1999 Lerner ..... B65B 43/123 53/373.6
6,042,046 A 3/2000 Beyer, Sr.
6,093,138 A 7/2000 Sorenson et al.
6,190,044 B1 2/2001 Fox et al.
6,286,681 B1 9/2001 Wilfong, Jr. et al.
6,318,893 B1 11/2001 Gates
6,651,406 B2 * 11/2003 Sperry ..... B31D 5/0073 156/147
6,675,557 B2 * 1/2004 Sperry ..... B29C 65/08 53/412
6,804,933 B2 10/2004 Sperry et al.
9,156,575 B2 10/2015 Potempa et al.
9,221,639 B2 * 12/2015 Wierenga ..... B65H 18/10
9,689,601 B2 6/2017 Hsu
2004/0045256 A1 * 3/2004 Kinigakis ..... B29C 66/1122 53/133.4
2011/0052352 A1 3/2011 Lambertini
2017/0081055 A1 * 3/2017 Honegger ..... B65B 43/59

OTHER PUBLICATIONS

Schur Technology A/S, Schur Start 2040-C Brochure, Bagging System with Numerous Options, Oct. 16, 2017, pp. 1-2.

* cited by examiner

AUTOMATIC BAGGING MACHINE HAVING ROLLSTOCK SUPPORT SPOOL

BACKGROUND OF THE INVENTION

1. Field of the Invention

The invention relates generally to rollstock supports onto which continuous webs of bags can be wound after manufacture and from which rollstock can subsequently be unwound during a bag filling operation. The invention additionally relates to an unwinder assembly incorporating such a rollstock support and to an automatic bagging machine incorporating such an unwinder assembly.

2. Discussion of the Related Art

Automatic and semi-automatic bagging machines are available for filling pre-formed bags with discrete items, such as produce items in the form of avocados, potatoes, onions, carrots, etc. The degree of automation and the accompanying bag filling rates vary dramatically from machine-to-machine. Some machines convey bags from a loading station, where individual bags or groups of bags are manually placed on the machine, either individually or in a magazine, to a filling station where the bags are filled using filling equipment, to a discharge station where the bags are manually or automatically discharged from the machine and closed—often manually. These machines may require at least one dedicated operator per machine and operate quite slowly. An example of these machines is a so-called carousel-style bagger in which the bags are manually hung on a rotating turret at a loading station, and the turret then rotates through a filling station into a discharge location.

Fully automated machines are available that do not require manual intervention on a per-bag basis. Automated bagging machines include so-called "rollstock baggers" that handle a continuous web or chain of interconnected, fully-formed or partially-formed bags wound onto a roll as "rollstock". If the bags are partially formed, the machine completes the converting or forming of bags prior to filling. If the bags are fully formed, the machine simply fills the bags and separates them from the web. In either event, the machine receives a web of material from the rollstock, fills the bags, separates the bags from the web, and discharges the filled bags from the machine, sometimes after sealing or otherwise closing the filled bags.

An example of an automatic bagging machine is one that accommodates a continuous strip or line formed from individual bags that is each connected at its upper end to a continuous carrier band or line, much as laundry is suspended from a clothesline. One such machine is available from Schur® Star Packaging Systems, Inc. under the model numbers 2040 or 3020. In this machine, a line supporting spaced individual bags is conveyed through the bagging machine, where the individual bags are filled, separated from the line, and possibly closed such as by heat sealing. The web, including the bags and line, is formed from during the bag manufacturing process, and is piled into cartons in a fan or Z-fold manner. Frequent stoppage is required to replace an empty carton with a full carton. The web also typically must be reoriented from a horizontal orientation to a vertical orientation as it is fed into the bagging machine with the aid of a relatively complex guide mechanism.

Higher capacity automatic bagging machines also are available in the form of so-called "rollstock baggers." Rollstock baggers include a bagging machine and an integrated unwinder assembly. The bagging machine typically receives a v-folded web of unformed, partially formed, or near-fully-formed bags from "rollstock" wound onto a vertically extending roll on an unwinder assembly positioned adjacent an inlet end or infeed of the bagging machine. In the case of a "horizontal rollstock bagger", the roll and web extend vertically, and the bags are filled from above. In this type of machine, the he web is conveyed horizontally through the bagging machine, where the side seals of the bags are partially formed or partially separated, the bags are filled, completely separated from one another, possibly closed, and discharged to a discharge conveyor or the like. Rollstock baggers have the advantage of operating fully automatically and very rapidly with no operator intervention and relatively little operator oversight. The rollstock can be formed from several thousand conjoined bags, permitting operation between changeovers for much longer periods of time than is the case with baggers handling individual bags manually hung, placed in magazines, or suspended from a line.

Rollstock intended for use with rollstock baggers must be wound onto an underlying core uniformly so that the rollstock being unwound from the core during a bagging process remains at a uniform height as it is conveyed into the bagging machine and so that no layers project beneath the bottom of the core so as to be crushed when the core is deposited into the unwinder assembly. Winding rollstock in this fashion is not particularly difficult with respect to non-gusseted polymer bags or other bags having a generally uniform thickness from their bottom end to their top end. However, winding rollstock uniformly onto a core is difficult with respect to bags that are thicker at one point along the vertical extent than another.

An example of such a bag is a bottom gusseted pouch-style bag, such as the one manufactured by Volm Companies, Inc. under the name "HALF-N-HALF POUCH." This bag is characterized by an upper film portion which may or may not have a zip lock or other closure and a bottom-gusseted lower mesh portion. Except in the area of the zip lock, where it is thicker, the upper portion of the bag consists of only two layers. The gusseted lower portion of the bag, however, consists of four layers over most of its extent and has six layers along a portion where the mesh and film portions of the outer walls of the bag overlap at the apex of the gusset. The lower portion of this bag thus is, on average, several times thicker than the upper portion of the bag. When a continuous web of such a bag is wound onto a core, the web tends to walk or telescope off one end of the core so that the outermost bags of the resulting rollstock extend well above the innermost bags. As a result of this walking or telescoping, bottom-gusseted, pouch-style bags and other bags varying considerably in thickness along their length cannot be employed as rollstock on automatic baggers.

These bags thus either must be separated from one another at the point of manufacture, shipped in stacks in boxes, and loaded onto bagging machines manually. All of these operations add substantial time and expense to the handling and bagging processes and prevent the filling of the bags using fully automated machines such as horizontal rollstock baggers. Alternatively, the bags can be attached to a carrier band or line during the manufacturing process and filled as described above. However, as mentioned above, a given web supplied to such a machine can contain only a few hundred bags and must be folded into cartons.

The need therefore has arisen to provide a mechanism facilitating the uniform winding of webs of bags of non-uniform thickness along their length to form rollstock while maintaining a uniform rollstock height.

The need additionally has arisen to provide an unwinder assembly compatible for use with a fully-automated bagging machine that delivers a continuous web of bags of the aforementioned type into the bagging machine at a uniform height.

The need additionally has arisen to provide an automatic bagger that can fill bags of the aforementioned type that are provided in the form of rollstock.

SUMMARY OF THE INVENTION

In accordance with an aspect of the invention, at least some of the noted needs are met through the provision of a rollstock support spool having a hollow core and first and second opposed rims. The hollow core has opposed axial ends, an inner peripheral surface defining a tubular opening configured for mounting over a spindle, and an outer peripheral surface configured to support rollstock. The rims are located at or near the first and second ends of the core, respectively. Each of the first and second rims has an inner axial surface, an outer axial surface, an inner peripheral surface defining an opening that is aligned with the opening in the core, and an outer peripheral surface. A radial spacing between the outer peripheral surface of the core and the outer peripheral surface of each of the rims is greater than a maximum thickness of the rollstock.

The effective length of the spool, defined as an axial spacing between the inner surfaces of the first and second rims, may be between 6" and 30" and more typically between 6" and 24". This effective length may be between ⅛" and ½" longer than a height of the rollstock.

The rollstock may be formed from bottom-gusseted, pouch-style bags.

In accordance with another aspect of the invention, an unwinder assembly for an automatic bagging machine is provided that can accommodate a spool as configured above. The unwinder assembly includes a table, a driven spindle supported on the table, and the rollstock support spool. The table may be mounted on a movable frame that can be raised and lowered by a drive motor and a drive arrangement. The motor may comprise an electric motor, and the drive arrangement may comprise a screw drive that is threadedly coupled to the frame. A monitor may be provided that monitors a height of the web of bags being withdrawn from the spool and that generates signals that are used to control the motor to adjust the position of the spool relative to the frame to maintain the height of the web of bags essentially constant during bagging. The monitor may be a photoeye.

In accordance with yet another aspect of the invention, an automatic bagger is provided having an unwinder assembly configured as described above. The bagging machine of this bagger may be a horizontal rollstock bagger.

These and other objects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings, in which like reference numerals represent like parts throughout, and in which.

DETAILED DESCRIPTION

An embodiment of FIGS. 1 and 2 of the invention now will be described, including an unwinder assembly of a horizontal rollstock bagger and an associated spool that deliver a web of bottom gusseted pouch-style bags to the bagging machine of the bagger. It should be understood, however, that many or all of the concepts discussed herein are applicable to other bags of variable thickness along their length, and that the rollstock support spool as disclosed herein and the associated unwinder assembly can be used with a variety of other bagging machines other than the horizontal rollstock bagger disclosed herein.

Figure 1:
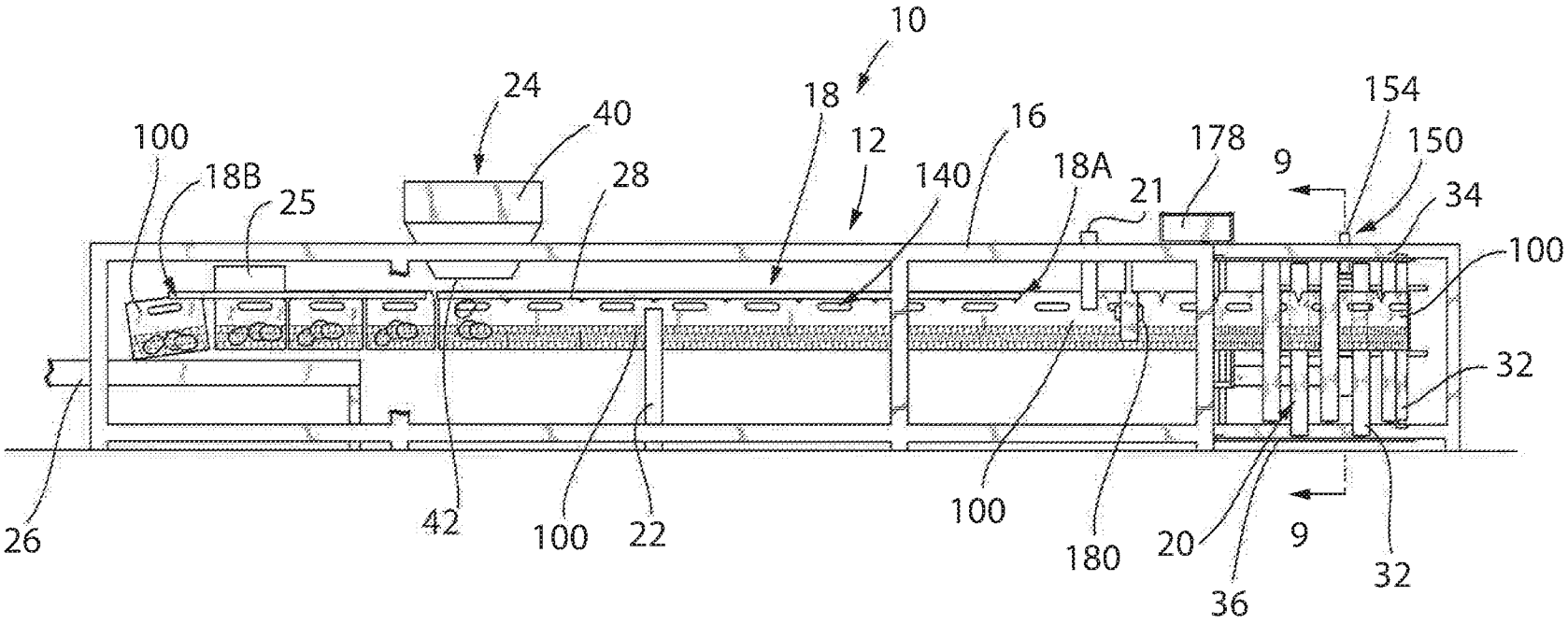
FIG. 1 is a somewhat schematic side-elevation view of a horizontal rollstock bagger incorporating an unwinder assembly constructed in accordance with an embodiment of the invention.
Figure 2:
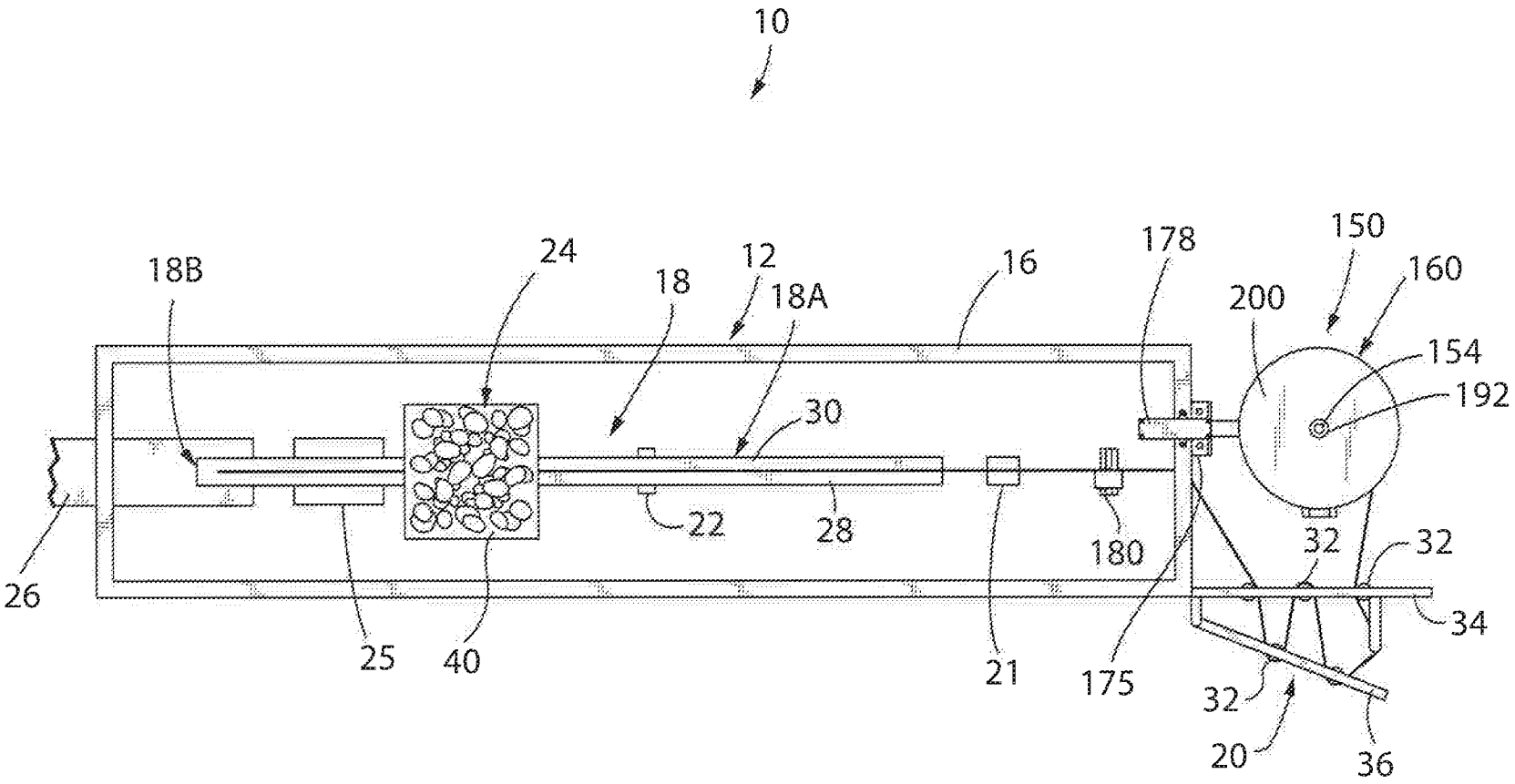
FIG. 2 is a top plan view of the bagger of FIG. 1.

Referring now to the drawings and initially to FIGS. 1 and 2, a rollstock bagger 10 is schematically illustrated that incorporates a bagging machine 12 and an unwinder assembly 150 constructed in accordance with the present invention. The bagging machine 12 has a stationary frame 16. A conveyor 18, formed from upstream and downstream sections 18A and 18B, is supported on the frame 16 and transports a web 140 of bags 100 from the unwinder assembly 150 and through the bagging machine 12. Moving from the upstream or infeed end to the downstream or discharge end, the bagging machine 12 includes a dancer roller assembly 20 and a perforator 21 located upstream of the upstream conveyor 18A, a heated cutter bar 22 mounted on the frame 16 near a midpoint of the bagging machine 12, a filling station 24 located downstream of the cutter bar 22 at the downstream end of the upstream conveyor section 18A, a closer 25 located adjacent the downstream conveyor section 18B, and a discharge conveyor 26 located beneath and extending downstream from the downstream conveyor-section 18B. Bagger 10 is controlled by an electronic controller 300, shown schematically in FIG. 10. The horizontal bagger 10, excluding the unwinder assembly 150 and associated components, may be a commercially-available bagger manufactured, for example, by Manter International, BV of Emmen Netherlands under the series RSB P.

Still referring to FIGS. 1 and 2, each conveyor section 18A and 18B takes the form of a pair of endless belts 28, 30 that convey the upper end of the web 140 of bags 100 horizontally through the bagging machine 12. The conveyor sections 18A and 18B are driven independently of one another, so that the downstream section 18B can be driven while upstream section 18A is stationary to separate a recently filled bag 100 from the end of the web 140. The conveyor sections 18 18A and 18B are driven by one or more electric motor(s) 302 (FIG. 10) under control of the controller 300.

Figure 8:
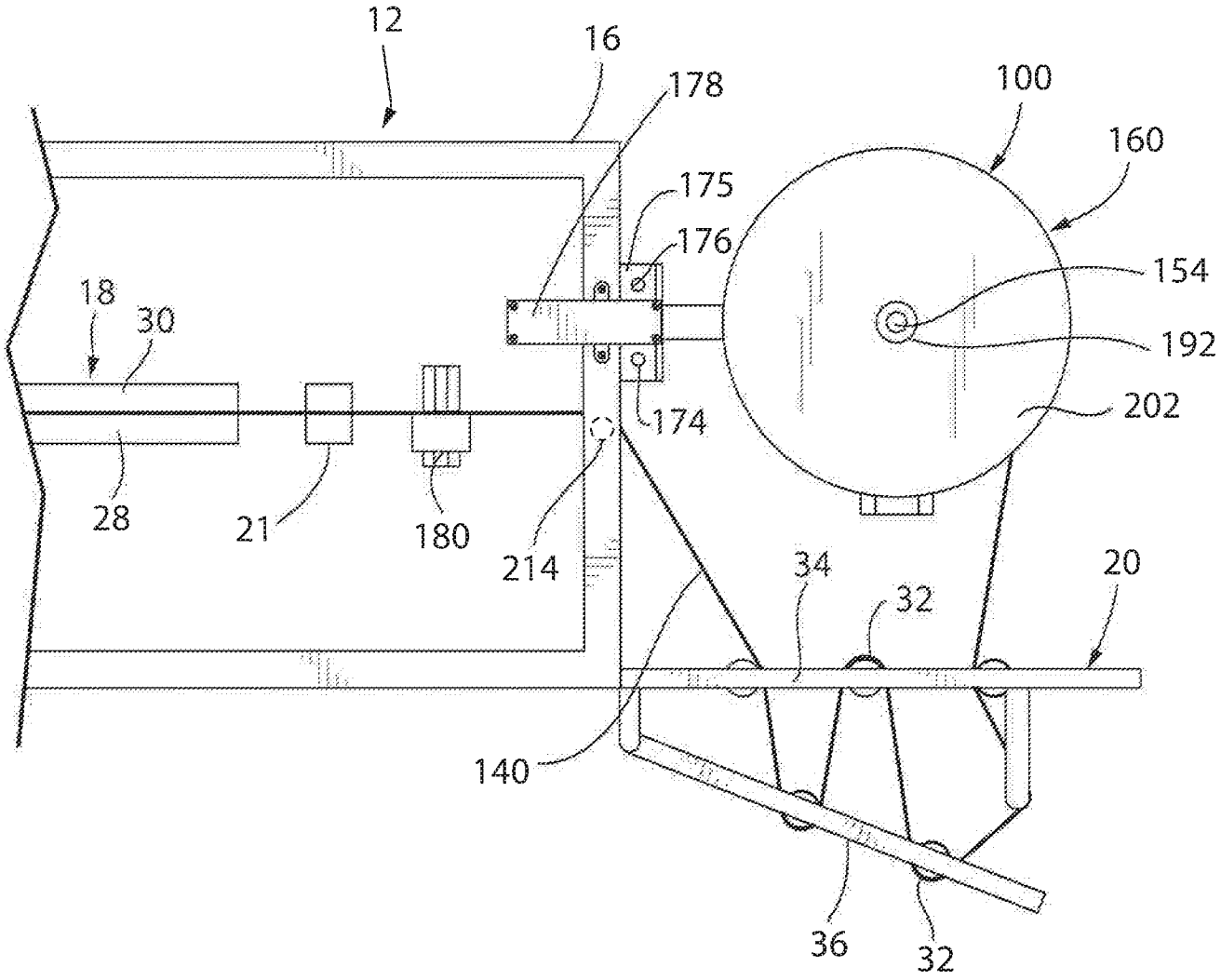
FIG. 8 is a top plan view of the unwinder assembly of FIGS. 6 and 7 and of the adjacent portions of the bagging machine.

Referring to FIGS. 1, 2 and 8, the perforator 21 is located between the dancer roller assembly 20 and the upstream end of conveyor section 18A. It may include a reciprocating serrated knife and an anvil located on opposite sides of the web 140. The knife can be driven toward and away from the anvil to perforate the edges of adjoined bags 100 along a vertical line extending downwardly about 2" to 3" from the top of the web 140.

Referring to FIGS. 1, 2, and 6-8, the dancer roller assembly 20 includes a number of longitudinally and transversely-spaced rollers 32, each having opposed ends rotatably mounted on a subframe 34 of frame 16. Some of the individual rollers 32 are mounted on a transversely movable portion 36 of the subframe 34 in a manner that is well-known to maintain proper tension on the web of bags 140 while accommodating slight mismatches in spool and belt motion.

Referring to FIGS. 1 and 2, the cutter bar 22 is a vertically-extending (heat) knife mounted on the frame 16 at a cutting station located upstream of the filling station 24. Cutter bar 22 can be driven by a drive, such as a pneumatic cylinder to reciprocate transversely toward and away from the from the conveyor 18 to separate the bottom portions of each adjacent pair of bags 100 from one another as the web of bags 140 moves intermittently through the cutting station. After this cutting, the bags 100 remain connected at their upper portions at the perforated section formed by perforator 21 with sufficient strength to permit the partially-separated web 140 to be pulled downstream toward the filling station 24 by the conveyor section 18A.

Still referring to FIGS. 1 and 2, the filling station 24 includes at least a hopper 40 located above the downstream end of conveyor section 18A. Filling station 24 also may include additional equipment (not shown) configured to discharge batches of a predetermined volume or predetermined weight of items into the hopper 40 in preparation for filling the bags 100. These items may, for example, comprise produce items such as avocados, potatoes, carrots, or onions. The bottom 42 of the hopper 40 is selectively opened by the controller 300 when an open bag 100 is aligned with the hopper bottom 42. An opening assembly, not shown, is located under the hopper 40. The opening assembly selectively opens each bag 100 after it is positioned under the hopper 40, holds the bag 100 open while the bag is filled, and then closes the bag 100. The upstream conveyor section 18A then remains stationary while the downstream conveyor section 18B is driven to separate the filled bag 100 from the web 140 and conveys that bag 100 away from the filling station 24.

Finally, at the discharge end of the bagging machine 12, each filled bag 100 is closed by the closer 25, which may for example, heat seal the upper end of the opposed walls of the bags together and/or close a zip lock or other integrated closure mechanism. The filled and closed bag 100 is then discharged from the downstream end of the conveyor section 18B, either by being cut at it its upper end by the closer or by being conveyed off the downstream end of the conveyor section, and is deposited onto the discharge conveyor 26. The discharge conveyor 26 then conveys the filled bags 100 downstream for further handling.

The bags 100 may be of any of a number of bag heights ranging from 6" or lower to 24" or higher. As mentioned below, the unwinder assembly 150 is configured to accommodate rollstock 142 formed from bags that vary considerably in thickness along their length. All-film bags having zip-locks exhibit some-such variation, and would be benefited by the unwinder assembly 150 disclosed herein. The disclosed bags 100, however, may be multi-substrate, bottom-gusseted, and-or pouch-style bags and are especially well-served by the combination of the unwinder assembly and spool disclosed herein.

Figure 3:
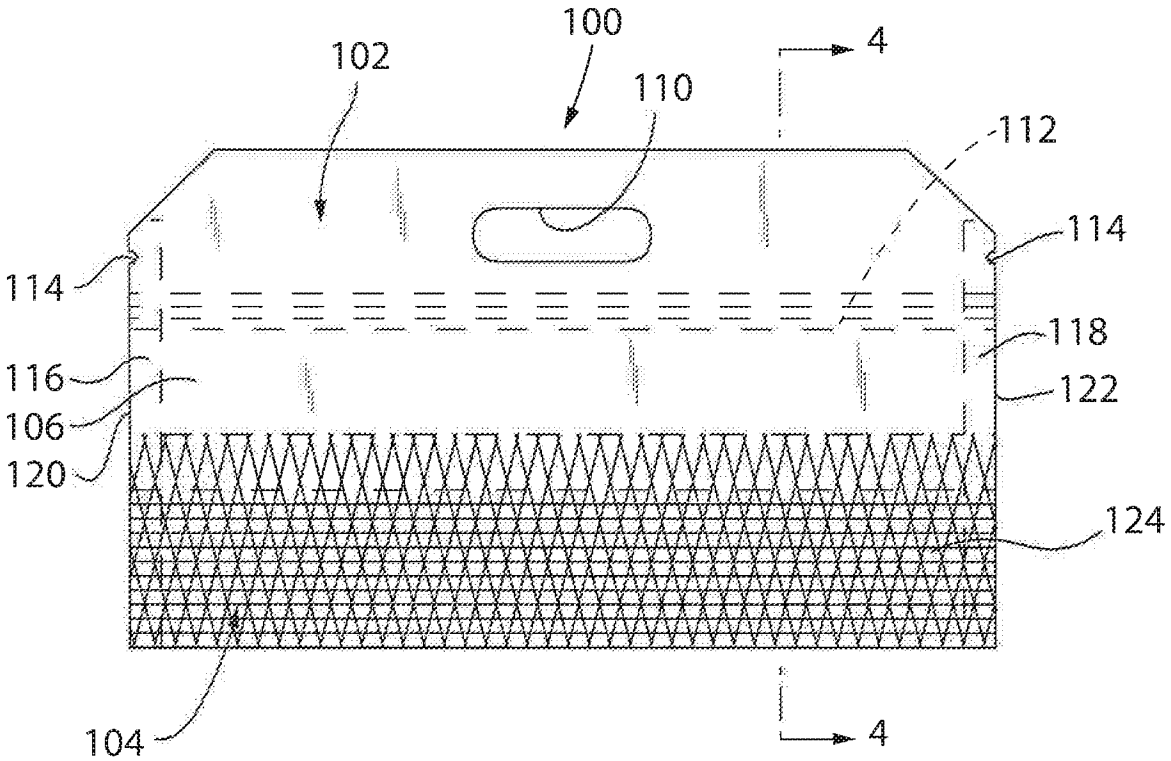
FIG. 3 is a side-elevation view of a bag filled by the bagger of FIGS. 1 and 2.
Figure 4:
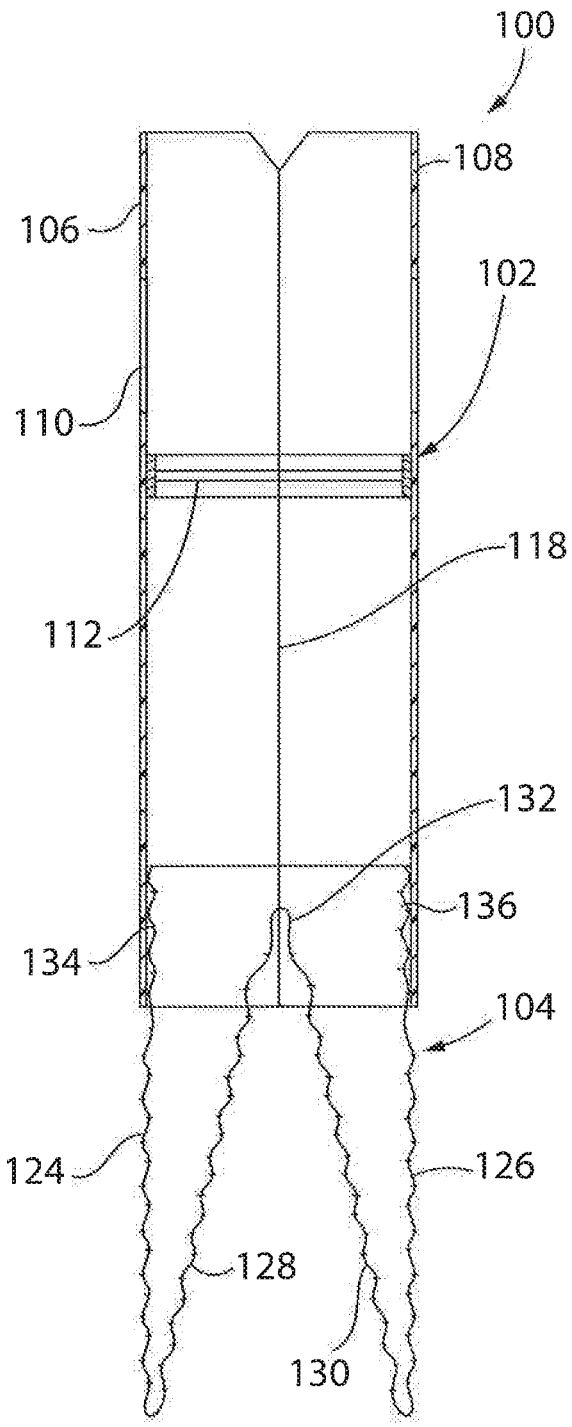
FIG. 4 is a sectional and elevation view of the bag taken generally along the line 4-4 in FIG. 3.

Referring now to FIGS. 3 and 4 the illustrated bag 100 is a relatively small-capacity bottom-gusseted, pouch-style bag configured to store produce items such as avocados. It is sold by Volm Companies, Inc. under the mark HALF-N-HALF POUCH. The illustrated bag 100 has a capacity of two lbs. and an unfilled width of about 12". The bag 100 has an upper, film portion 102 and a lower, mesh portion 104. The upper portion 102 has front and rear walls 106 and 108. A handle 110 and a closure 112 are provided in the upper portion 102 of the bag 100. The handle 110 takes the form of aligned openings formed through the upper portion of the front and rear walls 106 and 108, respectively. The closure 112 comprises a zipper or zip-lock disposed beneath the handle 110.

Each of the front and rear walls 106 and 108 is formed from a continuous strip of the film material, extending from the bottom end of the wall to the top end. Notches or tear areas 114 may be provided above the closure 112 to permit the top of the bag 100 to be torn off by the end consumer. The front and rear walls 106 and 108 are joined to one another along left and right vertically-extending side seams 116, 118 formed by thermally bonding the walls 106 and 108 together at their opposed left and right edges 120 and 122.

Still referring particularly to FIGS. 3 and 4, the bottom portion 104 of the bag 100 is gusseted to permit expansion of the bag 100 when it is filled with materials and, thus, to increase the volumetric capacity of a bag 100 of a given height and width. The bottom gusset is a so-called "single-gusset" in the present embodiment, having four panels 124, 126, 128, and 130. The outer panels 124 and 126 form the outer side walls of the lower portion 104 of the bag 100, and the inner panels 128 and 130 form a gusset having an apex 132. The upper end of each of the outer panels 124 or 126 is heat sealed to the interior surface of the bottom end portion of the associated upper wall 106 or 108 via a first horizontally-extending seam. Each of the left and right side edges of the first through fourth panels is thermally bonded to the corresponding edge of the other three panels by the side seams 116 and 118, which extend the entire height of the bag 100. The upper ends of the inner panels 128 and 130 extend above the bottoms of the walls 106 and 108, and thus also are bonded to the film material of the front and rear walls 106 and 108 at seams 134 and 136.

Figure 5:
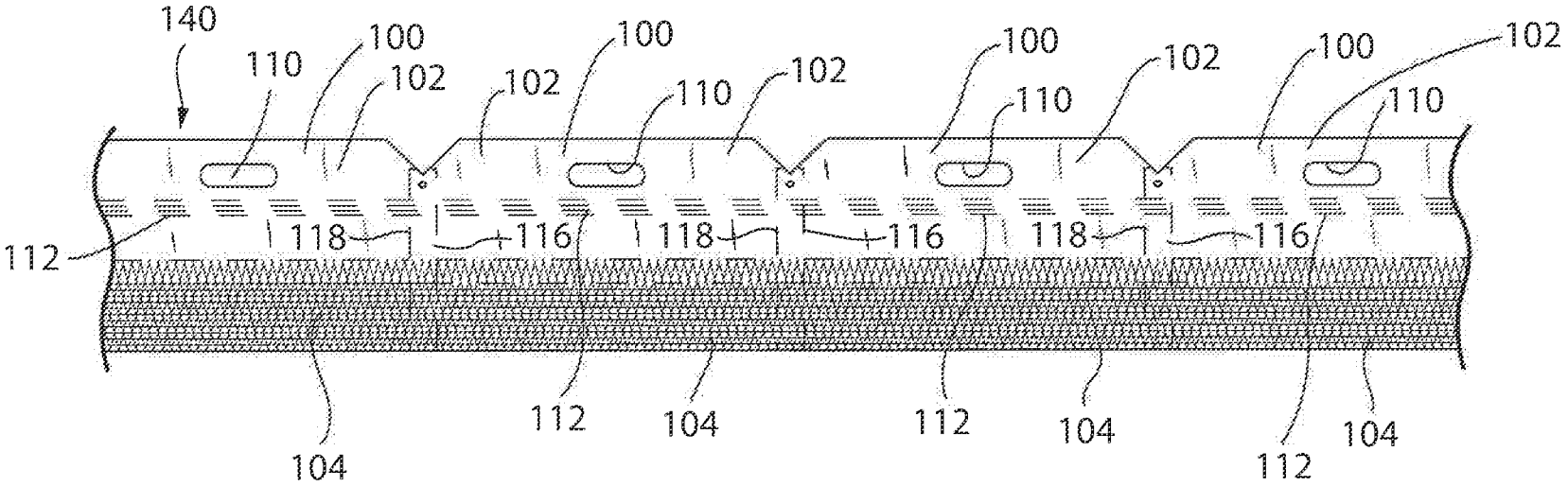
FIG. 5 is a side-elevation view of a continuous web of the bags of FIGS. 3 and 4, joined end-to-end.

Referring to FIG. 5, the bags 100 constructed as described above are formed as a continuous web 140 of conjoined bags 100 joined edge-to-edge by the side seams 116 and 118 of adjacent bags 100. The web 140 is wound onto a spool 160 at the end of the manufacturing process to form rollstock 142, best seen in FIG. 9. Because the bags 100 forming this rollstock 142 have only two layers at their upper ends and at least four layers at the lower ends, and six layers where the mesh material is sealed to the film material, each bag 100 is considerably thicker at its lower end than at its upper end. In fact, the thickness of an empty bag 100 varies about 0.075" between the thickest and thinnest portion of the bag. That variation in thickness may vary significantly based on factors such as the thickness of the film used in the bags. This unevenness accumulates as successive layers of bags 100, totaling up to 750 layers or more in a roll having 3000 bags, are wound onto the spool 160. The resulting rollstock 142 is significantly thicker at its bottom end then its top end. This unevenness tends to cause successive layers of the rollstock 142 to tend to "walk" or telescope axially of the spool 160 as the web 140 is wound onto the spool 160. The provision of a spool 160 (detailed below) rather than a simple core for supporting the rollstock 142 prevents excessive telescoping of the rollstock 142, as discussed in more detail below.

Figure 6:
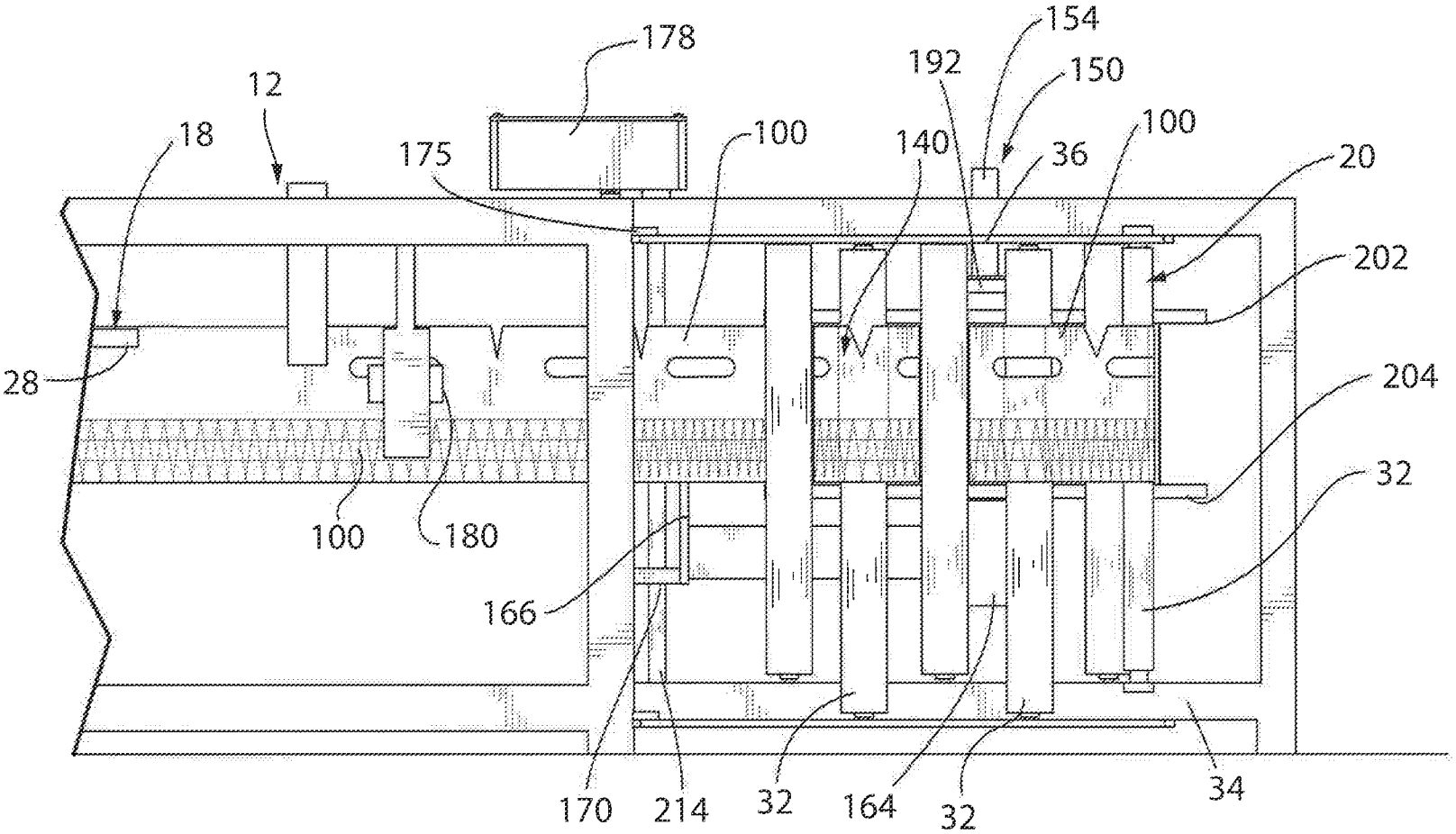
FIG. 6 is a side-elevation view of the unwinder assembly of the bagger of FIGS. 1 and 2 and of the infeed end of the bagging machine.
Figure 7:
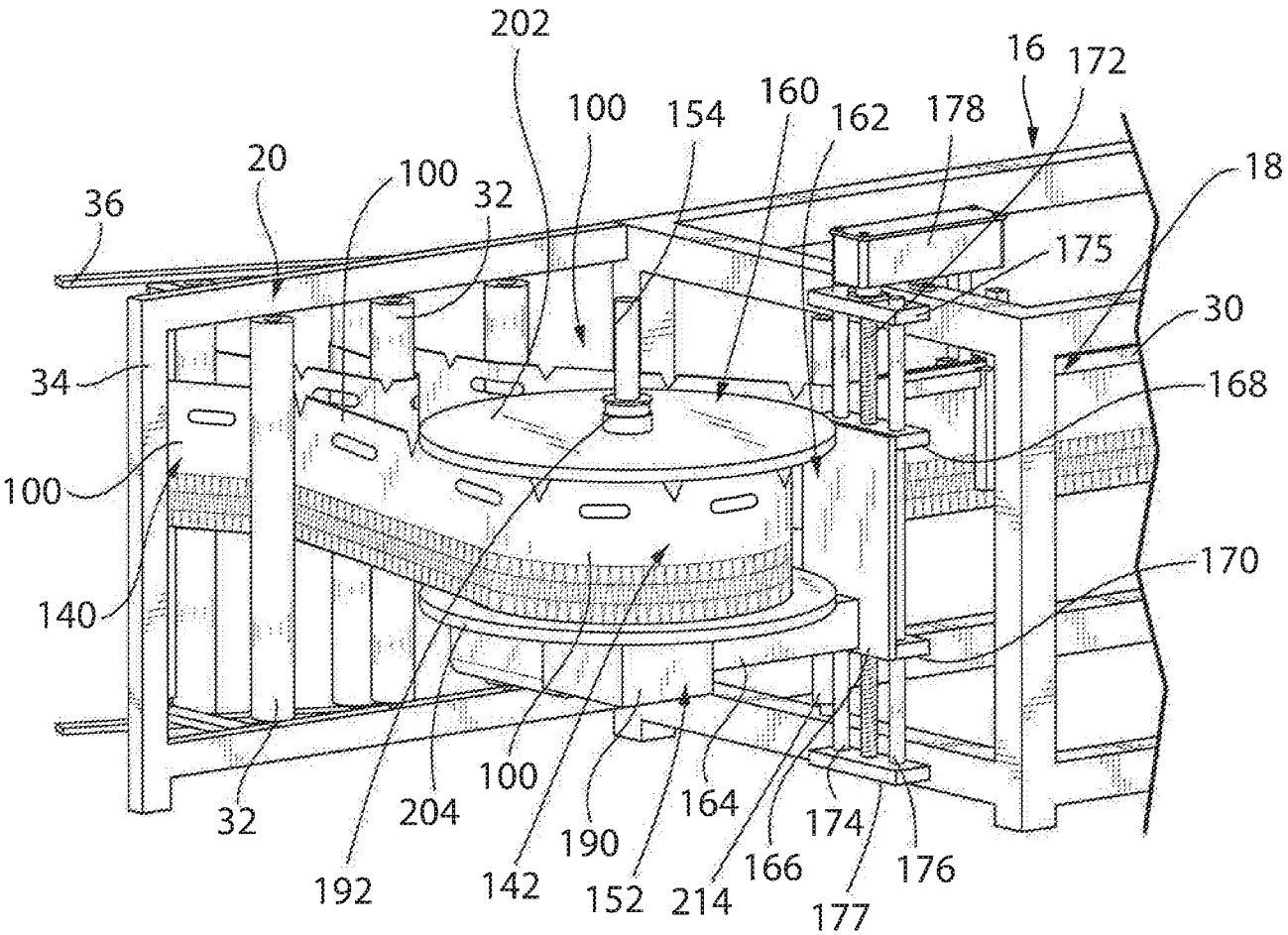
FIG. 7 is an isometric view of the unwinder assembly of FIG. 6 and of the adjacent portions of the bagging machine.
Figure 9:
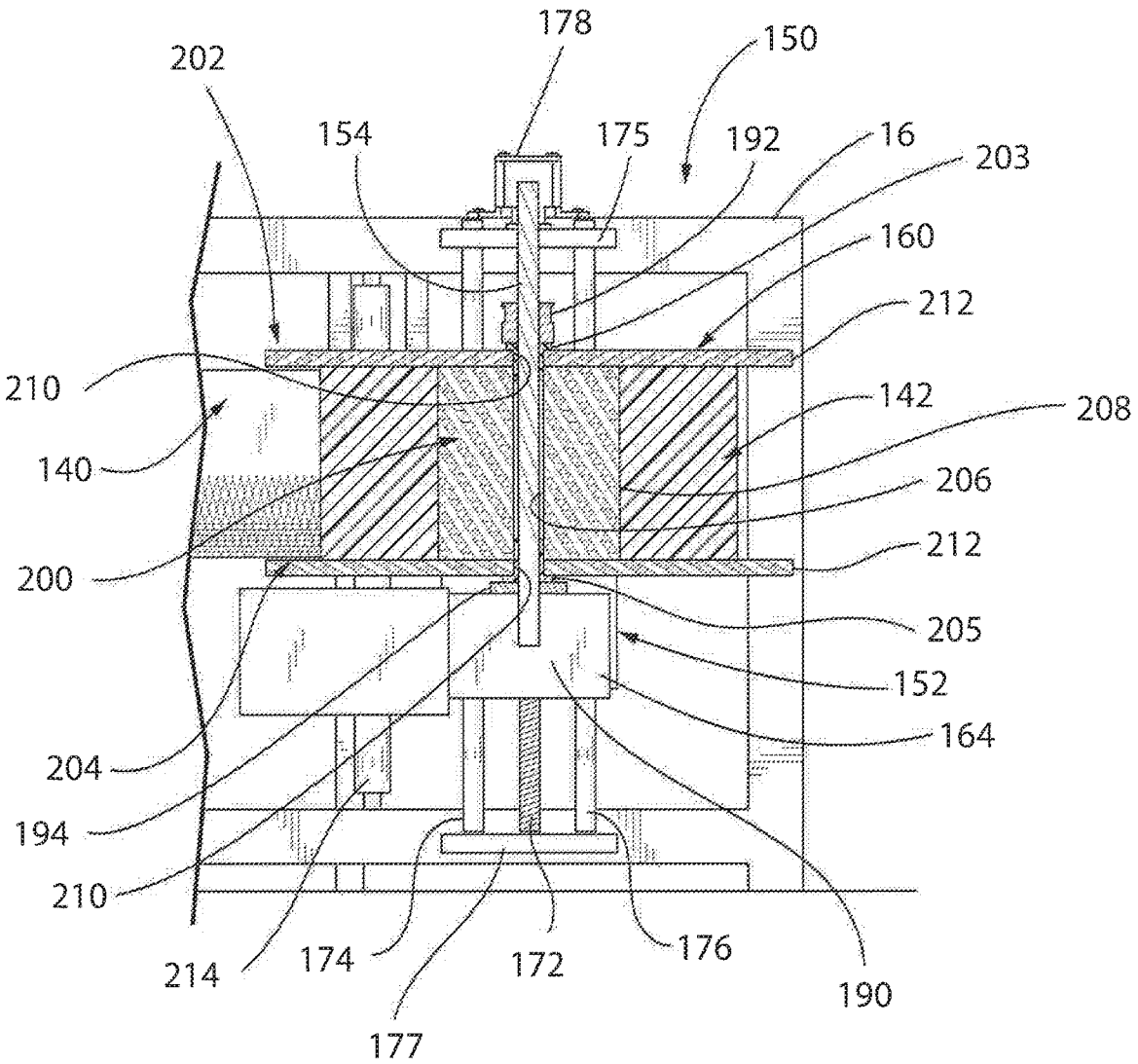
FIG. 9 is a sectional elevation view of a portion of the unwinder assembly of FIGS. 6-8.

Turning now to FIGS. 6-9, the unwinder assembly 150 includes a table 152 (FIGS. 7 and 9) that is mounted on a vertically movable table support frame 162, a driven spindle 154 that is supported on the table 152, and a rollstock support spool 160 that is supported on the spindle 154. The table 152 of this embodiment includes a motor housing 164 and associated mounting brackets that are collectively mounted on the table support frame 162 as best seen in FIGS. 7 and 9. The table support frame 162 includes a support plate 166 and upper and lower mounting plates 168, 170. The support plate 166 extends vertically so as to have front and rear surfaces, with the table 152 being mounted on the lower end of the front surface of the support plate 166. The upper and lower mounting plates 168 and 170 are mounted on the rear surface of the support plate 166 in a vertically-spaced relationship with respect to one another.

The table support frame 162 is mounted on the main frame 16 of the bagging machine 12 so as to be fixed from lateral or transverse movement but so as to movable relative to the frame 16. Table height adjustment is useful both during set-up to accommodate rollstock of various heights and during a bagging operation to accommodate relatively small fluctuations in the height of the web 140 being unwound from the spool 160. In the illustrated embodiment, first and second guide rods 174 and 176 collectively permit vertical movement of the table support frame 162 and table 152 relative to the frame 16 under operation of a screw drive 172. The screw drive 172 extends vertically through aligned threaded holes in the center of upper and lower support brackets 175 and 177 that are fixed to the frame 16 and the upper and lower mounting plates 168 and 170. Each of the guide rods 174 and 176 extends vertically through aligned holes in a respective end portion of the support brackets 175 and 177 and the mounting plates 168 and 170. Due to this arrangement, rotation of the screw drive 172 causes the threaded plates 168 and 170 to move vertically, with the guide rods 174 and 176 constraining the motion to a vertical plane.

Figure 10:
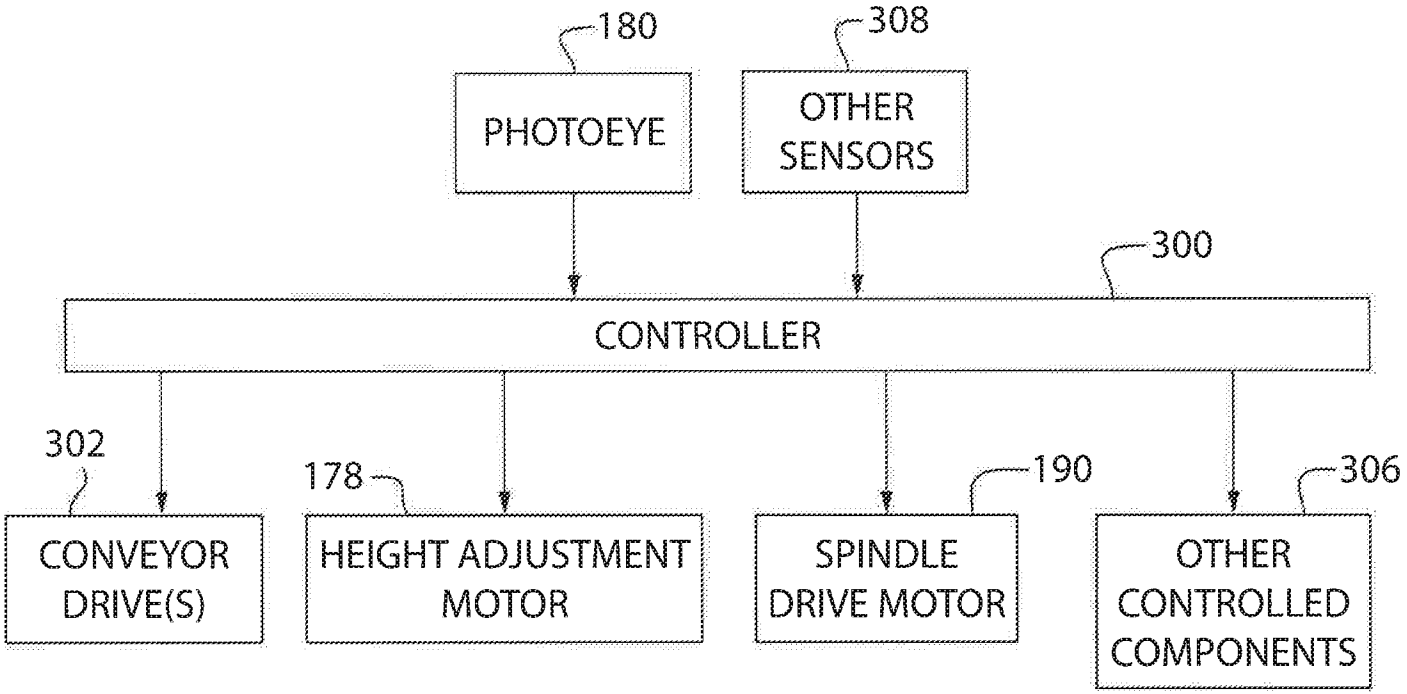
FIG. 10 schematically illustrates a control system of the bagger of FIGS. 1 and 2.

The screw drive 172 is selectively driven to rotate by an electric table height adjustment motor 178 mounted on top of the infeed end of the frame 16. The motor 178 may be controlled by the controller 300 of FIG. 10. The motor 178 may be actuated either to accommodate different rollstock heights during a set-up process, or during bag filling under feedback from a bag web height monitor that monitors the height of the web 140 of bags being fed into the drive belts 28, 30 from the dancer roller assembly 20. In the present embodiment, that monitor takes the form of a photoeye 180 that is mounted on the side of the frame 16 as best seen in FIG. 6 and that is coupled to the controller 300 as shown in FIG. 10. The illustrated assembly has a maximum adjustment stroke of about 21" for set-up purposes and an operational adjustment stroke under control of the photoeye 180 of about ¼" to 1", and more typically of about ½".

Still referring to FIGS. 6-9 and particularly to FIG. 9, the spindle 154 is rotatably supported on and extends upwardly from the motor housing 164 of table 152. The illustrated spindle 154 has a diameter of less than 3" to accommodate the 3" ID core 190. The spindle 154 is driven by an electric spindle drive motor 190 contained within the motor housing 164. The motor 190 may be controlled by the controller 300 of FIG. 10. The spindle 154 extends sufficiently far above the table 152 to receive the spool 160. The spool 160 is supported on a collar 194 that is clamped onto the spindle 154 above the motor housing 164. The provision of the clamp permits the vertical position of the collar 194 on the spindle 154 to be adjusted during changeover operations in order to provide additional spool height adjustment beyond that provided by the screw drive 172. The spool 160 is rotationally fixed to the spindle 154 by a drive pin (not shown) extending upwardly from the collar 194 into an opening in a lower core plug 205 of the rollstock support spool 160.

Referring to FIGS. 7-9, the rollstock support spool 160 includes a hollow core 200 and first and second (upper and lower) rims 202 and 204. The first and second rims 202 and 204 are attached to the core 200 at or near respective axial ends of the core 200 via respective core plugs 203 and 205. The rims 202 and 204 act as guides or barriers during a rollstock winding process that prevent rollstock 142 from telescoping off the ends of the spool 160. The resulting uniformly-wound rollstock 142 can be used on the horizontal rollstock bagger 10. The effective height of the illustrated spool 160, defined as the axial spacing between the rims 200 and 204, is about 6¼" inches high because the spool 160 is configured to support rollstock formed from 6" high bags. Effective spool heights of more than 24" are contemplated, however, for accommodating higher bags of up to 24". It is beneficial, however, that the effective spool height be no more than ½" greater than the height of the rollstock, and more typically, no more than ¼" greater than the height of the rollstock. This relatively small differential assures relatively even winding of the rollstock 142 onto the core 200.

Referring to FIG. 9, the core 200 has an inner peripheral surface 206 defining a tubular opening configured for mounting over the spindle 154, and an outer peripheral surface 208 configured to support the rollstock 142. The core 200 of this embodiment has an inner diameter of 3" and an outer diameter of 4". The core 200 and rims 202 and 204 may be made of cardboard, plastic, wood, metal, or any other suitably strong, durable material.

Still Referring to FIGS. 7-9, each rim 202 or 204 has an inner peripheral surface 210 and an outer peripheral surface 212. The inner peripheral surface 210 of each rim 202 or 204 is affixed to the respective end of the core 200 by a respective core plug 203 or 205. Each rim 202, 204 is considerably wider than the core 200 and, in fact, is configured to form a radial spacing between the outer peripheral surface 208 of the core 200 and the outer peripheral surface 212 of the rim 202 or 204 that is greater than a maximum thickness of the rollstock 142. Rim diameters of 10" to 24" or more with resultant radial spacings of 4" to 20" or more are contemplated. The rims 202 and 204 of the illustrated embodiment each have a diameter of 24", resulting in a radial spacing between the outer peripheral surface 208 of the core 200 and the outer peripheral surface 212 of the rims 202 and 204 of 20". The spool 160 can support up to 750 layers of the bottom-gusseted, pouch-style bags 100 described above.

In operation of the unwinder assembly 150, the assembly 150 is readied for operation by mounting a spool 160 on the collar 194 after positioning the collar at a desired location on the spindle 154, and then placing the top endcap 192 over the spool 160. The screw drive 172 is operated by motor 178 as necessary at this time to align the top of the rollstock 142 with the belts 28 and 30 of conveyor 18. The end of the web 140 of bags forming the rollstock 142 is then manually threaded around the dancer rollers 32, over an idler roller 214, and into the conveyor 18. The bagging machine 12 then is operated under control of the controller 300 of FIG. 10 to unwind the web 140 of bags 100 from the spool 160 and fill and separate the bags 100. Both the unwinder motor 190 and conveyor 18 are driven during this process on an intermittent basis. The height adjustment motor 178 can be operated by the controller 300 during this process under feedback from the photoeye 180 to raise and lower the table 152 as may be necessary to accommodate relatively small fluctuations (on the order of ½") in the height of the web 140 being withdrawn from the spool 160. The controller 300 also controls other components, collectively denoted 306, under control of other sensors 308. These components may include, amongst others, the perforator 21, the cutter bar 22, and the closer 25.

Depending on factors including the particular items being handled and the weighing and filling equipment being employed, the bagger 10 can fill the bottom-gusseted, pouch-style bags at a rate of 30 bags per minute, or even more. This rate is far higher than that which is possible with carousel-style baggers or other bagging machines that heretofore were required to fill bags 100 and other bags that could not be effectively wound into rollstock due to thickness variations along their length.

While the invention is described herein in connection with specific embodiment(s), it will be understood it is not intended to limit the invention to these embodiment(s). On the contrary, it is intended to cover all alternatives, modifications and equivalents as may be included within the spirit and scope of the invention as defined by the appended claims. The scope of these and other changes will become apparent from the appended claims.

I claim:

1. An unwinder assembly of an automatic bagger, the unwinder system comprising:

(A) a table;

(B) a driven spindle extending vertically above the table; and (C) a rollstock support spool supporting rollstock formed from a continuous web of interconnected bags, each of the bags being of non-uniform thickness along a bag height thereof, the rollstock support spool comprising:

(1) a hollow core having opposed axial ends, an inner peripheral surface defining a tubular opening that is mounted over the driven spindle, and an outer peripheral surface that supports the rollstock; and (2) first and second rims located at a first end of the hollow core and a second end of the hollow core, respectively, each of the first and second rims having an inner axial surface, an outer axial surface, an inner peripheral surface defining an opening that is aligned with the opening in the hollow core, and an outer peripheral surface, a radial spacing between the outer peripheral surface of the hollow core and the outer peripheral surface of each of the rims being greater than a maximum thickness of the rollstock;

(D) a drive motor that is configured to translate the table vertically to accommodate fluctuations in a web height of the continuous web of interconnected bags being withdrawn from the rollstock support spool during an unwinding process;

(E) a monitor that monitors the web height of the continuous web of bags being withdrawn from the rollstock support spool and that generates signals that are used to control the drive motor.

2. The unwinder assembly as recited in claim 1, further comprising a table support frame on which the table is supported, and further comprising a drive arrangement that is coupled to the drive motor and to the table support frame and that is configured to be driven by the drive motor to translate the table and the table support frame vertically.

3. The unwinder assembly as recited in claim 2, wherein the drive motor comprises an electric motor and the drive arrangement comprises a screw drive that is threadedly coupled to the table support frame.

4. The unwinder assembly as recited in claim 1, wherein the monitor comprises a photoeye.

5. The unwinder system as recited in claim 1, wherein each of the first and second rims of the rollstock support spool is affixed to the hollow core by a core plug.

6. The unwinder assembly as recited in claim 1, wherein an axial spacing between the inner axial surfaces of the first and second rims of the rollstock support spool is between 6" and 30".

7. The unwinder assembly as recited in claim 1, wherein an axial spacing between the inner axial surfaces of the first and second rims of the rollstock support spool is between ⅛" and 1" longer than a rollstock height of the rollstock.

8. The unwinder assembly as recited in claim 1, wherein a radial spacing between the outer peripheral surface of the hollow core and the outer peripheral surface of each of the rims of the rollstock support spool is between 6" and 30".

9. The unwinder assembly as recited in claim 1, wherein the bags are bottom-gusseted, pouch-style bags and/or zipper closure bags.

10. A rollstock bagger comprising:

(A) an unwinder assembly comprising:

(1) a table;

(2) a driven spindle extending vertically from the table;

(3) a rollstock support spool that supports rollstock formed from a continuous web of interconnected bags, each of the bags being of non-uniform thickness along a bag height thereof, the rollstock support spool comprising:

(a) a hollow core having opposed axial ends, an inner peripheral surface defining a tubular opening that is mounted over the driven spindle and an outer peripheral surface that supports the rollstock; and (b) first and second rims located at a first end of the hollow core and a second end of the hollow core, respectively, each of the first and second rims having an inner axial surface, an outer axial surface, an inner peripheral surface defining an opening that is aligned with the opening in the hollow core, and an outer peripheral surface, a radial spacing between the outer peripheral surface of the hollow core and the outer peripheral surface of each of the rims being greater than a maximum thickness of the rollstock;

(B) a conveyor that withdraws the continuous web of interconnected bags from the rollstock support spool;

(C) a drive motor that is configured to translate the table vertically to accommodate fluctuations in a web height of the continuous web of interconnected bags being withdrawn from the rollstock support spool during an unwinding process so as to maintain vertical alignment of the continuous web of interconnected bags with the conveyor;

(D) a monitor that monitors the web height of the continuous web of bags withdrawn from the rollstock support spool and that generates signals that are used to control the drive motor; and (E) a filler, located in alignment with a section of the conveyor, that fills the bags with items.

11. The rollstock bagger as recited in claim 10, wherein the rollstock bagger is a horizontal rollstock bagger and the conveyor is an endless belt extending horizontally between the unwinder assembly and the filler.

12. The rollstock bagger as recited in claim 10, wherein the bags are bottom-gusseted, pouch-style bags and/or zipper closure bags.

13. The rollstock bagger as recited in claim 10, wherein the drive motor comprises an electric motor; and further comprising a table support frame and a drive arrangement that comprises a screw drive that is threadedly coupled to the table support frame.

14. A rollstock bagger comprising:

(A) a rollstock support spool that supports rollstock formed from a continuous web of interconnected bags, each of the bags being of non-uniform thickness along a height thereof, the rollstock support spool comprising:

(a) a core having opposed axial ends, the core being mounted to a table, the core having an outer peripheral surface that supports the rollstock; and (b) a first rim and a second rim located at a first end of the core and a second end of the core, respectively, each of the first and second rims having an inner axial surface, an outer axial surface, an inner peripheral surface defining an opening that is aligned with an opening in the core, and an outer peripheral surface, a radial spacing between the outer peripheral surface of the core and the outer peripheral surface of each of the first and second rims being greater than a maximum thickness of the rollstock;

(B) a conveyor that withdraws the continuous web of interconnected bags from the rollstock support spool;

(C) an unwinder assembly comprising:

(1) the table;

(2) a table support frame on which the table is supported;

(3) an electric drive motor;

(4) a drive arrangement that is coupled to the electric drive motor and to the table support frame, wherein the electric drive motor is configured to drive the drive arrangement to translate the table and the table support frame vertically to vertically align the continuous web of interconnected bags with the conveyor by accommodating fluctuations in a height of the continuous web of interconnected bags as the continuous web of interconnected bags is withdrawn from the rollstock support spool;

(5) a monitor that monitors a web height of the continuous web of interconnected bags withdrawn from the rollstock support spool and that generates signals that are used to control the electric drive motor; and (D) a filler, located in alignment with a section of the conveyor, that fills the bags with items.

15. The rollstock bagger as recited in claim 14, wherein the rollstock bagger is a horizontal rollstock bagger and the conveyor is an endless belt extending horizontally between the unwinder assembly and the filler.

16. The rollstock bagger as recited in claim 14, wherein the bags are bottom-gusseted, pouch-style bags and/or zipper closure bags.

17. The rollstock bagger as recited in claim 14, wherein the drive arrangement comprises a screw drive that is threadedly coupled to the table support frame.

* * * * *